US006276276B1

(12) United States Patent
Erickson

(10) Patent No.: US 6,276,276 B1
(45) Date of Patent: Aug. 21, 2001

(54) THIN-FILM OPTICAL INITIATOR

(75) Inventor: Kenneth L. Erickson, Albuquerque, NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/377,190

(22) Filed: Aug. 19, 1999

(51) Int. Cl.[7] ..... F42C 19/00; C06B 45/12; C06B 45/14

(52) U.S. Cl. ..... 102/201; 149/14; 149/15

(58) Field of Search ..... 102/201

(56) References Cited

U.S. PATENT DOCUMENTS

| | | | | |
|---|---|---|---|---|
| H1214 | | 8/1993 | Liva et al. | 102/201 |
| 3,528,372 | * | 9/1970 | Lewis et al. | 102/70.2 |
| 3,724,383 | | 4/1973 | Gallaghan et al. | 102/70.2 A |
| 3,812,783 | | 5/1974 | Yang et al. | 102/70.2 R |
| 4,870,903 | * | 10/1989 | Carel et al. | 102/201 |
| 5,099,761 | * | 3/1992 | Betts et al. | 102/201 |
| 5,179,246 | * | 1/1993 | Betts et al. | 102/201 |
| 5,191,167 | | 3/1993 | Beyer | 102/201 |

OTHER PUBLICATIONS

R.G. Jungst et al., "Development of Diode Laser–Ignited Pyrotechnic and Explosive Components", Proceedings of the Fifteenth International Pyrotechnics Seminar, Jul. 9–13, 1990.

"Development of Thin–Film Samples for Examining Condensed–Phase Chemical Mechanisms Affecting Combustion of Energetic Materials", K.L. Erickson, R.D. Skocypec, W.M. Trott, and A.M. Renlund presented at the "Proceedings of the Fifteenth International Pyrotechnics Seminar", Jul. 9–13, 1990.

* cited by examiner

*Primary Examiner*—Peter M. Poon
*Assistant Examiner*—Aileen J. Baker
(74) *Attorney, Agent, or Firm*—Dickson G. Kehl; Virginia B. Caress; Paul A. Gottlieb

(57) ABSTRACT

A thin-film optical initiator having an inert, transparent substrate, a reactive thin film, which can be either an explosive or a pyrotechnic, and a reflective thin film. The resultant thin-film optical initiator system also comprises a fiber-optic cable connected to a low-energy laser source, an output charge, and an initiator housing. The reactive thin film, which may contain very thin embedded layers or be a co-deposit of a light-absorbing material such as carbon, absorbs the incident laser light, is volumetrically heated, and explodes against the output charge, imparting about 5 to 20 times more energy than in the incident laser pulse.

14 Claims, 1 Drawing Sheet

THIN-FILM OPTICAL INITIATOR

GOVERNMENT RIGHTS

The United States Government has rights in this invention pursuant to Contract No. DE-AC04-94AL85000 between the U.S. Department of Energy and Sandia Corporation.

FIELD OF THE INVENTION

This invention pertains to initiators for reactive materials, such as explosives or pyrotechnics. More specifically, it relates to low-power laser activated initiators.

BACKGROUND OF THE INVENTION

The range of application for low-power laser initiators, particularly laser diode devices, is somewhat limited. For example, several secondary explosives are not currently amenable to low-power laser initiation. However, the range of application could be substantially extended by thin-film boosters that efficiently absorb the laser energy and explode against an output charge of secondary explosive.

Laser initiation of explosives and pyrotechnics has been well-documented, and results from prompt initiation studies using pulsed, high-power lasers have been reported in the literature for several years. The use of low-power lasers as the energy source in initiators designed to replace conventional low-energy hot-wire devices is an emerging technology. Laser diodes are a particularly attractive energy source. They are small, lightweight, easily packaged, and the optical energy can be delivered using a fiber optic cable that is directly coupled to them. The increased safety and reliability of such optical devices can be substantial, relative to the corresponding hot-wire device. In particular, the electrical hazards due to electrostatic discharge, stray current pick up, and lightning are eliminated.

Known in the art is a technique for optically detonating insensitive explosives using a high-energy Q-switched laser. The high explosive can be housed in a cylinder having a transparent window at one end. The window has a thin metallic coating on its inner side placed so as to be in contact with the explosive. The light energy from the laser vaporizes the metal, detonating the explosive. (U.S. Pat. No. 3,812,783, "Optically Detonated Explosive Device," issued to Lien C. Yang el al on May 28, 1974.)

It is also known to use electro-optics to safely control initiation of multiple igniters in a chain of explosive devices. U.S. Pat. No. H001214, "Multiple Point Laser Detonation System For Explosive Charges," issued to Michael Liva et al on Aug. 3, 1993, describes each igniter connected via a fiber patch cord to a bushing; and U.S. Pat. No. 5,191,167, "Multi-Point Fiber Optic Igniter," issued to Richard A. Beyer on Mar. 2, 1993, describes multiple igniters displaced along a linear fiber optic such that light energy transmitted at an epoxied connection of each igniter will energize an explosive at that location along the fiber optic, thus enabling near simultaneous discharge of multiple explosive devices.

Further, it is also known to transmit energy via fiber optics to the first of two chambers which contains an aspherical glass-focusing head to distribute the initiating light pulse. From there the focused light is sent to a second chamber containing a low-energy laser which initiates the explosive. A secondary explosive, potassium hexanitrodiphenylamine (KHND), is initiated by the laser to a low-order detonation, in turn initiating another secondary explosive, pentaerythritol tetranitrate (PETN), yielding the desired high-order detonation. (U.S. Pat. No. 3,724,383, "Laser Stimulated Ordnance Initiation Device," issued to John A. Gallaghan et al on Apr. 3, 1973.)

There is, therefore, a need for a thin-film optical initiator which amplifies the energy from a low-energy laser source to initiate ignition of an output charge, using relatively insensitive explosives or pyrotechnics, which involves conventional semiconductor manufacturing steps and, therefore, provides an assurance of stability during manufacture and in subsequent use.

Accordingly, it is an object of the invention to provide an alternative initiator to conventional direct irradiation of a reactive charge used in a variety of devices, which is intended to directly replace low-energy hot-wire devices conventionally used to initiate explosive devices.

It is yet another object of the invention to provide a thin-film initiator which amplifies the energy from a relatively low-energy laser source and initiates ignition of the output charge of a device to be set off.

It is also an object of the invention to initiate secondary explosives, such as an organic (CHNO) explosive by a low-power laser, particularly a laser diode, to develop a class of insensitive optical initiators using relatively insensitive explosives, where coupling of the low-energy laser energy with the energetic material is very efficient and reproducible.

It is another object of the invention to provide initiators that are significantly safer to manufacture, handle, and use than existing electronic (hot-wire), percussion, or high-energy laser initiators, particularly in cases where primary explosives are used.

It is also an object of the invention to reduce particle creep effects and gap formation between the thin film and the output charge, which may be less critical than between header and powder in a device using direct irradiation of the granular output charge.

Another object of the invention is to greatly simplify the analysis of the laser light interaction with energetic material in that the thin films have simple geometry and more easily determinable and reproducible optical properties, thus facilitating modeling and design, resulting in decreased testing requirements and time to bring a component into production.

It is also another object of the invention to simplify the performance of optical continuity checks, making them safer than electrical checks, by using very low-power pulses or alternate wavelengths that have minimal interaction with the energetic material.

It is also an object of the invention to fabricate thin-film low-power optical initiators using available thin-film deposition techniques and equipment so that they can be easily mass produced, resulting in little variability between items.

Finally, it is an object of the invention to minimize batch-to-batch variations in production lots of initiators via introduction of a much-simplified composition for the thin-film initiator.

SUMMARY OF THE INVENTION

These and other advantages of this invention are obtained by depositing on a transparent, inert substrate (or window), successively, a layer of reactive thin film, which can be either an explosive or a pyrotechnic, (about 5 to 20 microns thick) and a layer of reflective thin film which may be a metal, such as aluminum (about 1 to 2 microns thick). The resultant thin-film optical initiator also consists of a fiber optic cable connected to a low-energy laser source, an output charge, and an initiator housing. The reactive thin film may contain a light-absorbing material such as carbon, either co-deposited with the reactive material or as very thin embedded layers. The reactive thin film absorbs the incident laser light, is volumetrically heated, and explodes against the output charge, imparting about 5 to 20 times more energy than in the incident laser pulse.

Other objects, advantages, and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWING

The accompanying drawing, which is incorporated into and forms a part of the specification, illustrates one aspect of the present invention and, together with the detailed description, serves to explain the principles of the invention. The drawing is only for the purpose of illustrating a preferred embodiment and is not to be construed as limiting the invention to only that structure. The drawing illustrates a perspective schematic view through the proposed thin-film optical initiator to illustrate a preferred embodiment.

DESCRIPTION OF THE PREFERRED EMBODIMENT

Figure 1:
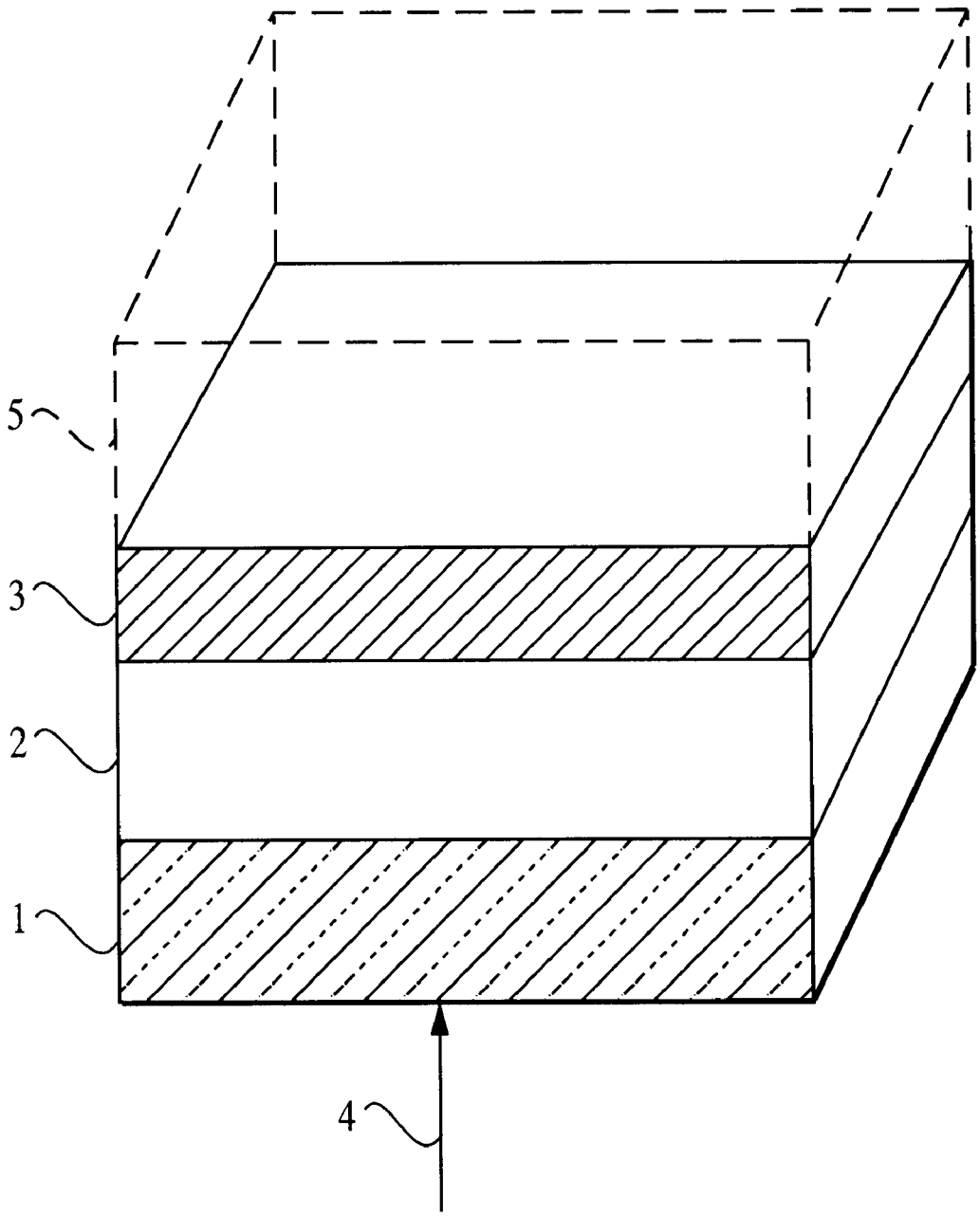

The invention provides for a class of electrically insensitive optical initiators to be used with relatively insensitive reactive chemical compounds. This technology, in turn, provides a class of initiators that are significantly safer to manufacture, handle, and use than existing electronic (hot-wire), percussion, or high-energy laser initiators. The resultant increases in safety, reliability, and efficiency also contribute to an overall reduction in life-cycle costs for any system employing the technology of the invention.

The thin-film optical initiator of the invention is shown in the drawing. Although the drawing is not to scale, salient features include: an inert, transparent substrate 1, a reactive thin film 2, which may be a co-deposited single-layer mixture or stratified composition of explosive or pyrotechnic and light-absorbing materials; a reflective thin film 3 separating the reactive thin film 2 from the output charge 5, as well as confining the reactive thin film 2; a fiber optic cable 4 (which is shown diagrammatically, not physically) connected to a low-energy laser source, preferably a low-energy laser diode; and the output charge 5. The initiator further has a housing (not shown).

The thin-film optical initiator can be powered by a relatively low-energy laser source that is enabled by either co-depositing or separately depositing on a transparent, inert substrate 1, successively, a layer of reactive thin film 2 (about 5 to 20 microns thick) and a layer of reflective thin film 3, which may be a metal, such as aluminum (about 1 to 2 microns thick), which is immediately adjacent and in contact with the output charge 5. The reactive thin film 2 may contain very thin embedded layers of a light-absorbing material, such as carbon. As the coherent light from the low-energy laser is absorbed by the reactive thin film 2 or alternating reactive and light-absorbing layers, volumetric heating of the mixture occurs relatively uniformly. When the temperature of the explosive or pyrotechnic is sufficient for a violent reaction, the reactive thin film 2 explodes against the reflective thin film 3, causing the reflective thin film 3 to fragment or melt. In turn, once this reflective thin film seal 3 is breached, the transmitted energy is sufficient to ignite the output charge 5. The output charge 5, preferably a granular explosive or pyrotechnic material, is ignited via a combination of particle impact and convective heat transfer from the hot expanding gases resulting from the ignition of the reactive thin film 2. Amplification achieved by the thin-film optical initiator is on the order of 5 to 20 times the received energy level. The thin-film optical initiator is fabricated using processes and equipment common to the semiconductor industry.

The transparent, inert substrate 1 typically can be of various thicknesses and is purchased or fabricated separately and then bonded or sealed in place. Substrate materials have included rutile, various glasses, and most predominantly sapphire and quartz crystals and Pyrex. The selection of substrate material is based upon a number of considerations, including index of refraction, strength, thermal conductivity, thermal expansion, cost, and manufacturing, The reflective thin film 3 completely covers the reactive thin film 2 and forms a seal with the substrate 1 and acts as an interface between the reactive thin film 2 and the output charge 5. In one embodiment, a reflective material, which can be a metal, such as aluminum, is deposited in a film, which is 1 to 2 $\mu$m thick; this reflective thin film 3 serves also as a reflector for the second pass embodiment described below. The type of reflective material is selected for its ability to fragment or melt when the temperature of the reactive thin film 2 is sufficient to initiate a violent reaction within the reactive thin film 2; it can be a metal, ceramic, plastic, glass, or any other appropriately reflective material.

According to the invention, the substrate 1 must allow for transmission of coherent light from the low-energy laser with minimal losses, it must have sufficient mechanical strength to maintain physical integrity upon functioning of the reactive device, and it must have a thermal conductivity as low as possible. If the surface of the fiber optic cable 4 is used as the substrate 1, it would not be physically protected from the reaction.

Specifically, the thin-film optical initiator can be activated using available low-energy commercial laser diodes and used for ignition of reactive devices that are conventionally energized by hot-wire semiconductor bridges, Q-switched laser sources, or mechanical (percussion) assemblies. By internally amplifying energy received at the initiator by factors of 5 to 20 times, the source energy required is reduced to that level appropriate to a laser diode, i.e., about one mJ/ms received at the thin-film optical initiator. In addition to the invention's use of standard manufacturing processes using existing semiconductor fabrication techniques and equipment, thin-film optical initiators are able to be packaged in a size amenable to retrofit in many existing cases and devices, if need be.

In a preferred embodiment, the reactive thin film 2 may be 5 to 20 $\mu$m thick, or more. It may consist of alternating layers of an organic (CHNO) explosive, such as hexanitrostilbene (HNS), cyclonite (RDX), octogen (HMX), sym-triaminotrinitrobenzene (TATB), or PETN, and very thin layers (<5 $\mu$m) of an efficient light-absorbing material, such as amorphous carbon. The number and thickness of light absorbing layers, if any, are chosen to conform to the wavelength desired for operation of a particular initiating device. Other factors to be considered include the light absorption (i.e., within the wavelength of the chosen low-energy laser diode source) of the deposited reactive material, the thickness of any alternating layers of light absorbing material, and the spacing of the absorbing material and the reactive material layers. For example, layers of light-absorbing material can be omitted if the light absorption of the selected explosive or pyrotechnic material is such that most of the incident light is absorbed in the first 5 to 20 $\mu$m. In such a case, this will permit sufficient heating of the material to bring about the required violent reaction to initiate the output charge 5.

Unless the reactive thin film 2 is thin enough for a one-watt source to energize it, the initiator itself will have the same initiation problems as the output charge 5. These problems are solved in the invention by the use of semiconductor manufacturing methods to provide the requisite micro-thin film of photoreactive material.

If the light absorption of the reactive thin film 2 is too low for the energy to be absorbed in a single pass, a second pass can be used and is achievable by reflection off the reflective thin film 3. Proper use of this reflected energy also ensures more uniform heating of the reactive thin film 2. The thickness and light absorption capacity of the reactive thin film 2 should be designed such that essentially all of the remaining incident energy is absorbed in these reflected second passes. There are specific concepts that can be applied to assure that this second pass yields most of its energy to the reactive thin film 2. The use of light-absorbing layers could also be combined with the use of a second pass.

If the absorptance of the reactive thin film 2 is too low to absorb sufficient energy with a second pass, then the light-absorbing layers can be deposited at predetermined intervals (about 1 to 5 $\mu$m apart) to create local heating regions throughout the reactive thin film 2. The location and thickness of the light-absorbing layers can be varied to provide relatively uniform volumetric heating of the reactive thin film 2.

For most organic (CHNO) explosives, the heat of explosion is about 1 kcal/g (4.2 kJ/g), and the specific heat is about 0.3 cal/g° C. (1.2 J/g° C.). Reasonable diameters for spot sizes that will ensure sufficient energy deposition from the fiber optic cable 4 are from 0.01 to 0.1 cm. The density of the secondary explosives of interest to be used in the reactive film 2 is about 1.8 g/cm$^3$. Assuming a 10 $\mu$m ($10^{-3}$ cm) thick reactive thin film 2 and a spot size having an area of about $10^{-3}$ cm$^2$, the mass of the heated film is about $1.8\times10^{-6}$ g. Therefore, the energy of explosion of the heated film would be about 8 mJ.

Thin-film optical initiators are fabricated using, existing fabrication techniques and modern equipment for vapor depositing metals, such as aluminum, and light-absorbing materials, such as amorphous carbon. Further, specific techniques, using modified existing equipment, have been developed for vapor deposition of thin films (0.01 to 20 $\mu$m) of a variety of organic (CHNO) explosives, including RDX, HMX, HNS, and TATB. (See "Development of Diode Laser-Ignited Pyrotechnic and Explosive Components," R. G. Jungst, F. J. Salas, R. D. Watkins, and L. Kovacic and "Development of Thin-film Samples for Examining Condensed-Phase Chemical Mechanisms Affecting Combustion of Energetic Materials," K. L. Erickson, R. D. Skocypec, W. M. Trott, and A. M. Renlund both presented at the "Proceedings of the Fifteenth International Pyrotechnics Seminar" on Jul. 9–13, 1990.)

A reasonable estimate of the required energy for achieving a violent reaction in the thin-film optical initiator should be given approximately by the energy needed to heat $1.8\times10^{-6}$ g of the explosive to about 500° C. That energy is about 1 mJ; therefore a 1 mJ energy input should be sufficient to heat the reactive thin film 2 to violent reaction. The actual heating achieved depends on the heat losses from the thin-film initiator. These losses are minimized by ensuring rapid, uniform volumetric-type heating. When the reactive thin film 2 reacts violently, the energy released by the exploding film is about an order of magnitude greater than that provided by the low-energy laser diode source, i.e., tens of Joules. Coupling the energy from the exploding reflective film 3 to the granular output charge 5 does involve some uncertainties. However, with this type of thin-film initiator, the goal is to overdrive the system so that the energy deposited from the reactive thin film 2 and the reflective thin film 3 is well above the threshold needed to initiate the output charge 5.

Relatively sensitive explosives such as CP (2-[5-cyanotetrazolato] pentamine cobalt (III) perchlorate) have been initiated by relatively low-energy laser diodes using light pulses having pulse widths from 2 to 10 milliseconds. The efficiency of energy transfer can be increased by the addition of at least one layer of a dopant; e.g., carbon black, to absorb a significant percentage of light energy transmitted at some predetermined wavelength.

In one embodiment, light-absorbing layers are interstratified with the reactive material, using amorphous carbon, for example, at intervals of up to 5 $\mu$m apart, in order to create local heating regions throughout the reactive thin film 2. Location and thickness of the light-absorbing material can be varied to optimize volumetric heating of the reactive thin films 2. These interstratified light-absorptive layers are used with either first pass ignition or reflective second pass ignition. This reactive composition is deposited on an inert, transparent substrate 1 and sealed using a reflective thin film 2 that is 1–2 $\mu$m thick. The photo-absorptive layer nearest the reflective thin film 3 serves to facilitate the absorption of energy reflected from the reflective thin film 3, as well as energy absorbed directly on the first pass of the light energy. This built-up thin-film optical initiator is then inserted in a housing suitable for use in an end item. Applications of this invention include weapons systems, small arms, commercial blasting, pyrotechnics for fireworks, and virtually any device where re-use of the energizing source is desirable.

Because of the volumetric heating provided by the interstratified layers of photo-absorptive material, the option to choose either a lower energy source or a less sensitive reactive material is possible. Further, proper selection of materials will permit testing the continuity of the fiber optic cable 4 without initiating the device, simply by using wavelengths not absorbed by the reactive material or by attenuating the energy of the laser diode source.

In another preferred embodiment (not shown), the light-absorbing material is co-deposited to form an intimate mixture with the reactive material using existing semiconductor fabrication techniques and equipment. This co-deposited layer is used with either first pass ignition or reflective second pass ignition. This reactive composition is deposited on an inert, transparent substrate and sealed using a reflective thin film that is 1–2 $\mu$m thick. This thin-film optical initiator is then inserted in a housing suitable for use in an end item which includes an output charge. Applications of this invention would be the same as previously indicated.

In another preferred embodiment (not shown), the substrate is the output end of a fiber optic cable. A reactive thin film, approximately 20 $\mu$m thick, is vapor deposited on the end of a suitable fiber-optic cable with appropriate connectors for connection of the fiber optic cable to both the housing and the laser diode. It is then sealed with a reflective thin film 1–2 μm thick, which may be a metal, such as aluminum. The modified end of the fiber-optic cable is then brought into physical contact with a granular output charge of secondary explosive enclosed in a suitable housing. The other end of the fiber-optic cable is then connected to a suitable low-energy laser diode source, providing approximately 1 watt (average) received power at the interface with the thin films. Applications further include automotive airbags, downhole seismic exploration, construction excavation, and demolition.

Although the invention has been described in detail with particular reference to these preferred embodiments, other embodiments can achieve similar results. The aforementioned values and configurations can be varied and are cited solely for illustrating particular embodiments of the invention. Variations and modifications of the present invention will become apparent to those skilled in the art. It is intended to cover in the appended claims all such modifications and equivalents. All publications cited above are hereby incorporated by reference.

I claim:

1. An optical initiator for initiating rapid detonation of a main charge of energetic material by amplifying applied energy, comprising:

a) a transparent, inert substrate;

b) a reactive thin film, comprising at least one layer of reactive material superjacent said substrate; and c) a reflective thin film, comprising at least one layer superjacent said reactive thin film.

2. The optical initiator of claim 1, wherein said substrate is about 0.1 to 50 microns thick, said reactive thin film is about 5 to 20 μm thick, and said reflective thin film is about 0.1 to 2 microns thick.

3. The optical initiator of claim 1, wherein said reactive thin film consists of at least one layer of an organic (CHNO) explosive.

4. The optical initiator of claim 3, wherein said explosive is selected from the group comprising cyclonite (RDX), octogen (HMX), hexanitrostilbene (HNS), sym-triaminotrinitrobenzene (TATB), pentaerythritol tetranitrate (PETN), and mixtures thereof.

5. The optical initiator of claim 1, wherein said reflective thin film is selected from the group consisting essentially of metals, plastics, ceramics, and glasses.

6. The optical initiator of claim 5, wherein said reflective thin film is aluminum.

7. The optical initiator of claim 1, wherein said reactive thin film comprises at least one layer of said reactive material and at least one layer of a photo-absorptive material.

8. The optical initiator of claim 1, wherein said reactive thin film comprises a co-deposited layer of said reactive material and a photo-absorptive material.

9. The optical initiator of claim 8, wherein said photo-absorptive material is amorphous carbon.

10. The optical initiator of claim 1, further comprising a fiber-optic cable having an input end and an output end, said output end acting as said substrate for said reactive thin film.

11. The optical initiator of claim 10, wherein said reactive thin film is sealed by a reflective thin film.

12. The optical initiator of claim 11, wherein said reflective thin film is selected from the group consisting essentially of metals, plastics, ceramics, and glasses.

13. The optical initiator of claim 12, wherein said reflective thin film is aluminum.

14. The optical initiator of claim 11, wherein the reflective thin film is brought into physical contact with an output charge of secondary explosive.

* * * * *